United States Patent [19]

Flint et al.

[11] 4,363,457

[45] Dec. 14, 1982

[54] WEB TENSIONING SYSTEM

[75] Inventors: John R. Flint, Barrington; Kenneth L. Hendrikson, Chicago; K. George Rabindran, Morton Grove, all of Ill.

[73] Assignee: Bell & Howell Company, Chicago, Ill.

[21] Appl. No.: 203,934

[22] Filed: Nov. 4, 1980

[51] Int. Cl.[3] ..... G03B 1/04; G11B 15/32

[52] U.S. Cl. ..... 242/203; 318/7

[58] Field of Search ..... 242/75.5, 75.51, 186, 242/190, 191; 360/71, 73, 74; 318/6, 7

[56] References Cited

U.S. PATENT DOCUMENTS 3,606,201 9/1971 Petusky ..... 242/190

3,704,401 11/1972 Miller ..... 318/7

3,715,641 2/1973 Mattes ..... 318/7

*Primary Examiner*—Leonard D. Christian

*Attorney, Agent, or Firm*—John H. Moore; Alan B. Samlan; Alan H. Haggard

[57] ABSTRACT

A system is described for holding the tension of a web substantially constant as the web is transported from a supply spool to a take-up spool. The rotation of each spool is controlled by a motor. A tension control circuit senses the currents in both motors and alters motor current so as to hold the sum of the motor currents at a substantially constant value. In this manner, the sum of the torques generated by the motors and their spools is held at a substantially constant value to thereby maintain web tension substantially constant as the radii of the spools change during web movement.

1 Claim, 6 Drawing Figures

WEB TENSIONING SYSTEM

BACKGROUND OF THE INVENTION

The invention is directed generally to web transports, and particularly to a system for controlling the tension in a web as it is transported from a supply spool to a take-up spool.

In systems which transport web material such as microfilm at high rates of speed, a lack of proper tension in the web allows air to become trapped between adjacent layers of web on the take-up spool. As a result, sliding or "cinching" frequently occurs between adjacent layers of web on the take-up spool.

In an attempt to avoid such cinching, some prior web transports have applied a constant hold back torque on the supply spool. Tension is thus imposed on the web and, if the radii of the spools do not change appreciably as the web is collected on the take-up spool, a fairly constant tension is imposed on the web and little cinching occurs.

In systems in which larger amounts of web are transported, the radii of the take-up and supply spools may change by a factor of two or more as the web is advanced from the supply spool to the take-up spool. Because web tension varies in inverse proportion to spool radius, at least where a constant hold back torque is applied to the supply spool, the web tension varies considerably. Consequently, it is difficult to avoid cinching and simultaneously avoid imposing too much tension on the web.

Other transport systems employ a capstan between the take-up and supply spools to control web velocity, and apply a constant torque on the motor which rotates the take-up spool. Once again, web tension varies as the spool's radii changes. This problem is commonly corrected by mechanically sensing web tension and servo-controlling the torque on the take-up motor. However, such methods of controlling web tension are too expensive for many applications.

Accordingly, a general object of the invention is to provide an improved system for controlling web tension in a web transport system.

It is a more specific object of the invention to provide a reliable and inexpensive system for holding web tension substantially constant, irrespective of large changes in the radii of the supply and take-up spools.

BRIEF DESCRIPTION OF THE DRAWINGS

The objects stated above and other objects of the invention are set forth more particularly in the following detailed description and in the accompanying drawings, of which.

DESCRIPTION OF THE PREFERRED EMBODIMENT

Figure 1:
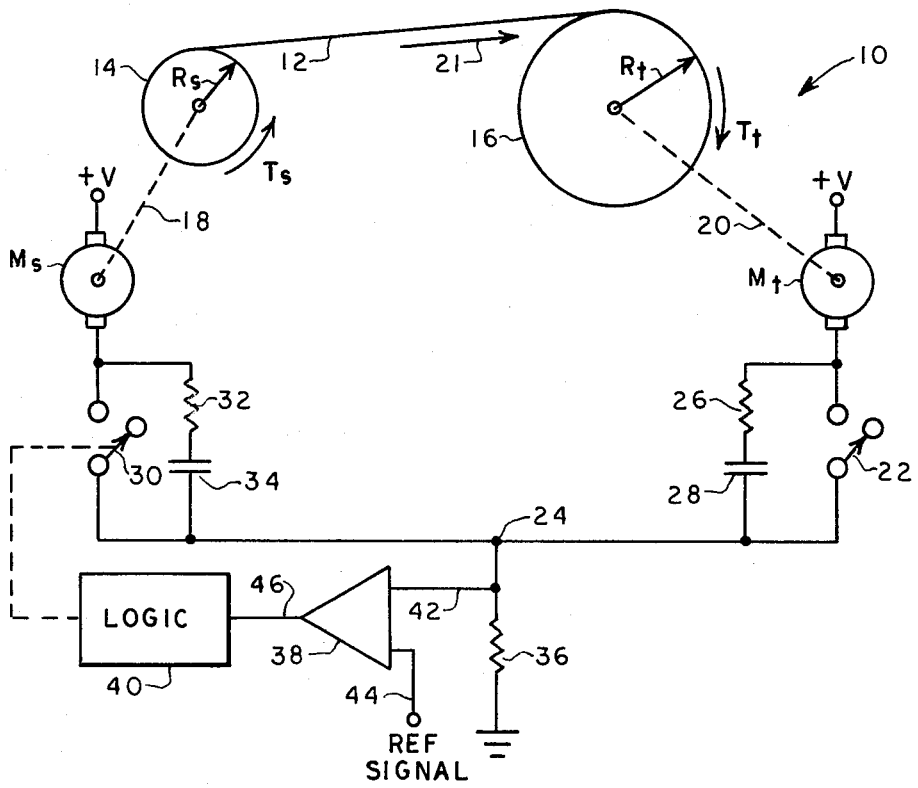
FIG. 1 is a diagram of a web tensioning system according to the invention.

Referring to FIG. 1, a transport system 10 is shown for moving a web 12 from a supply spool 14 to a take-up spool 16 so as to hold the tension in the web 12 at a substantially constant value. The supply spool 14 is coupled to a supply motor $M_s$ via a suitable mechanical linkage 18. The take-up spool 16 is coupled to a take-up motor $M_t$ via another linkage 20. When the take-up motor is energized, the web 12 is advanced in the direction of the arrow 21 for collecting the web on the take-up spool 16.

In some conventional transport systems, a current is supplied to the supply motor $M_s$ for creating a constant hold-back torque $T_s$ on the supply spool 14 to thereby place the web 12 under tension. However, as the web is collected on the take-up spool, the radius $R_s$ of the supply spool decreases while the radius $R_t$ of the take-up spool increases. Since the web tension imparted by the supply spool is equal to the torque $T_s$ of the take-up spool divided by the radius $R_s$, web tension varies considerably as $R_s$ decreases.

The present invention holds web tension substantially constant as the web is collected on the take-up spool 16 by creating a hold back-torque $T_s$ on the supply spool and by holding substantially constant the sum of the torque $T_s$ and the torque $T_t$, the latter being the torque on the take-up spool imparted by the motor $M_t$. In this manner, a web tension $T_e$ is created which is equal to $T_k \div (R_s + R_t)$ where $T_k = T_s + T_t$. Because the torque $T_s$ is proportional to the current in the supply motor $M_s$, and the torque $T_t$ is proportional to the current in the take-up motor $M_t$, a substantially constant torque $T_k$ is created by holding the sum of the currents in the motors $M_s$ and $M_t$ at a substantially constant value. Hence, web tension $T_e$ is also held at a substantially constant value.

In the present embodiment, the motor $M_t$ is coupled to one end of a switch 22, the other end of the switch being coupled to a current summing node 24. A resistor 26 and a capacitor 28 may be coupled across the switch 22 to protect it from back EMF (electromotive force) developed by the motor $M_t$ due to it's inductance.

The motor $M_s$ is coupled to one side of a switch 30, the other side thereof being connected to the node 24. A resistor 32 and a capacitor 34 may be coupled across the switch 30 to protect the switch 30 from the back EMF associated with the supply motor.

To advance the web in the direction of the arrow 21, the switch 22 is closed to energize the take-up motor for rotating the spool 16. The switch 22 remains closed as long as it is desired to continue collecting the web on the take-up spool. As the take-up motor comes up to speed, its current decreases. The motor $M_s$ is then supplied with a current whose value is selected such that the sum of the motor currents remains substantially constant.

To sense the value of the motor currents, a resistor 36 is coupled between ground and the node 24. Hence, an output signal is generated at the node 24 which is indicative of the sum of the currents in the motors. That output signal is used to vary the current in the supply motor $M_s$ in response to changes in the value of the current in the motor $M_t$ so as to hold the sum of the motor currents at a substantially constant value.

Toward this end, the system includes a comparator 38 and a logic circuit 40 coupled between the node 24 and the switch 30. The comparator 38 receives two inputs, one on a lead 42 and another on a lead 44. The input on lead 42 is the signal at node 24 indicative of the value of the summed motor currents. The input on the lead 44 is a reference signal which is indicative of a value of summed motor currents calculated to create a desired tension on the web. The comparator 38 compares the value of the signal on lead 42 to the value of the signal on the lead 44 and generates, on its lead 46, a digital control signal indicative of the difference between its inputs.

The logic circuit 40 receives the control signal on the lead 46 and responds to the latter signal by varying the current in the motor $M_s$ such that the value of the signal on lead 42 is brought closer to the value of the signal on the lead 44. In other words, the sum of the motor currents is made substantially equal to their desired sum as represented by the reference signal on the lead 44.

Such control of the current in the motor $M_s$ is preferably effected by changing the position of the switch 30 so that it is periodically opened and closed for pulse width modulating the current in the motor $M_s$. When the current in the motor $M_t$ is much smaller than the desired sum of the motor currents, the logic circuit 40 holds the switch 30 closed for a relatively long interval before opening it again to lengthen the width of the current pulses in the motor $M_s$. Stated another way, the duty cycle of the motor $M_s$ is increased for this condition. Conversely, when the current in the motor $M_t$ is nearly as large as the desired sum of the motor currents, the logic circuit 40 holds the switch 30 closed for a relatively short interval before opening it again to shorten the width of the current pulses in the motor $M_s$, thus shortening the supply motor's duty cycle.

In normal operation, the switch 30 is initially open and the switch 22 is closed so that current flows from the supply voltage +V, through the motor $M_t$, and to ground through the resistor 36. The initial value of the current in the motor $M_t$ will be large due to the inertia of the system. As the motor $M_t$ rotates faster, its current diminishes and the comparator 38 and logic circuit 40 operate to open and close the switch 30 to supply the motor $M_s$ with current pulses whose duty cycle increases. Consequently, as the torque $T_t$ decreases, the hold-back torque $T_s$ increases such that the sum of the motor torques remains substantially constant. Hence, the tension on the web 12 also remains substantially constant.

Figure 2:
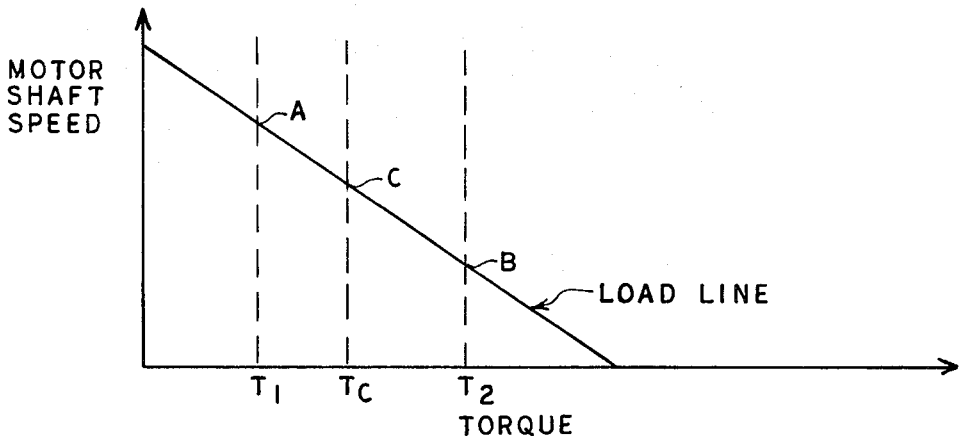
FIG. 2 is a plot of motor shaft speed versus motor torque to illustrate the operating characteristics of the motors shown in FIG. 1.

Referring now to FIG. 2, the operating characteristics of a typical D.C. motor are shown of the type used in the present transport system. The illustrated characteristics are based on the assumption that the D.C. motor is connected in the transport system as shown in FIG. 1, and that the transport system is in a state of equilibrium. The load line in FIG. 2 depicts the relationship between motor shaft speed and torque. Assuming that the load line is for the motor $M_t$, the take-up spool 16 develops a torque $T_1$ when its radius $R_t$ is minimum (when all the web is on the supply spool). The value of that minimum torque is equal to web tension times the minimum radius of the take-up spool 16. When the radius of the take-up spool is maximum (all of the web is on the take-up spool), the spool 16 has a larger torque $T_2$ whose value is equal to the product of web tension and the maximum radius of the take-up spool. Because the sum of the torques associated with the spools remains constant, the web tension at point A is equal to the web tension at point B. Between points A and B, web tension decreases slightly.

At point C on the load line, the radius of the take-up spool is equal to the square root of $(R^2\ \max + R^2\ \min) \div 2$, where $R^2$ max is the square of its maximum radius and $R^2$ min is the square of its minimum radius. At that point, a torque $T_c$ is developed, where $T_c$ is defined by the equation shown below:

$$T_C = T_E \times \frac{\frac{R_t\,\max}{R_t\,\min} + 1}{\sqrt{2\left[\left(\frac{R_t\,\max}{R_t\,\min}\right)^2 + 1\right]}}$$

In this equation, $T_e$ is the torque generated when the radius of the take-up spool is minimum, $R_t$ max is the maximum value of the radius $R_t$, and $R_t$ min is the minimum value of the radius $R_t$.

Figure 3:
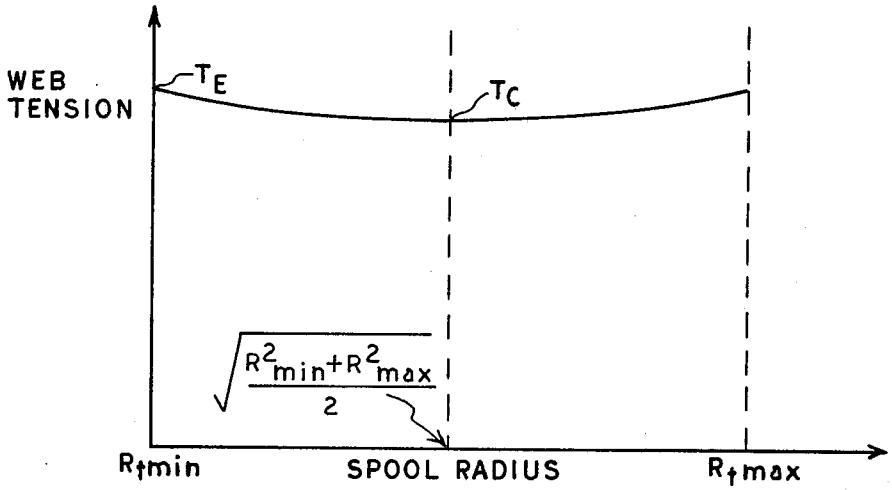
FIG. 3 is a plot of web tension versus spool radius for the system shown in FIG. 1.

The extent to which web tension is controlled by holding the sum of the motor currents constant is depicted in FIG. 3. As shown, web tension at the minimum radius of the take-up spool is equal to the web tension at the maximum radius of the take-up spool. At the intermediate radius point, the torque $T_c$ is developed and web tension at that point is slightly less than $T_e$. The specific value of web tension at $T_c$ may be calculated from the equation shown in FIG. 2. The small resulting deviation in web tension at $T_c$ does not noticeably detract from the transport system's ability to collect web on the take-up spool without cinching.

In order to select the desired value of the sum of the motor currents needed to hold web tension constant, one may start by selecting a web tension $T_e$ which is suitable for a particular application. Because the maximum and minimum spool radii are known values, the summed torque $T_k$ can be calculated from the equation: $T_k = T_e \times (R\ \max + R\ \min)$. The summed current $I_k$ needed to develop the summed torque $T_k$ may then be calculated on the basis of the motor characteristics, and a reference voltage indicative of the value of the current $I_k$ may be applied to the comparator 38 (FIG. 1). The system will then operate to hold the sum of the motor currents substantially equal to $I_k$ as the web is collected on the take-up spool.

Figure 4:
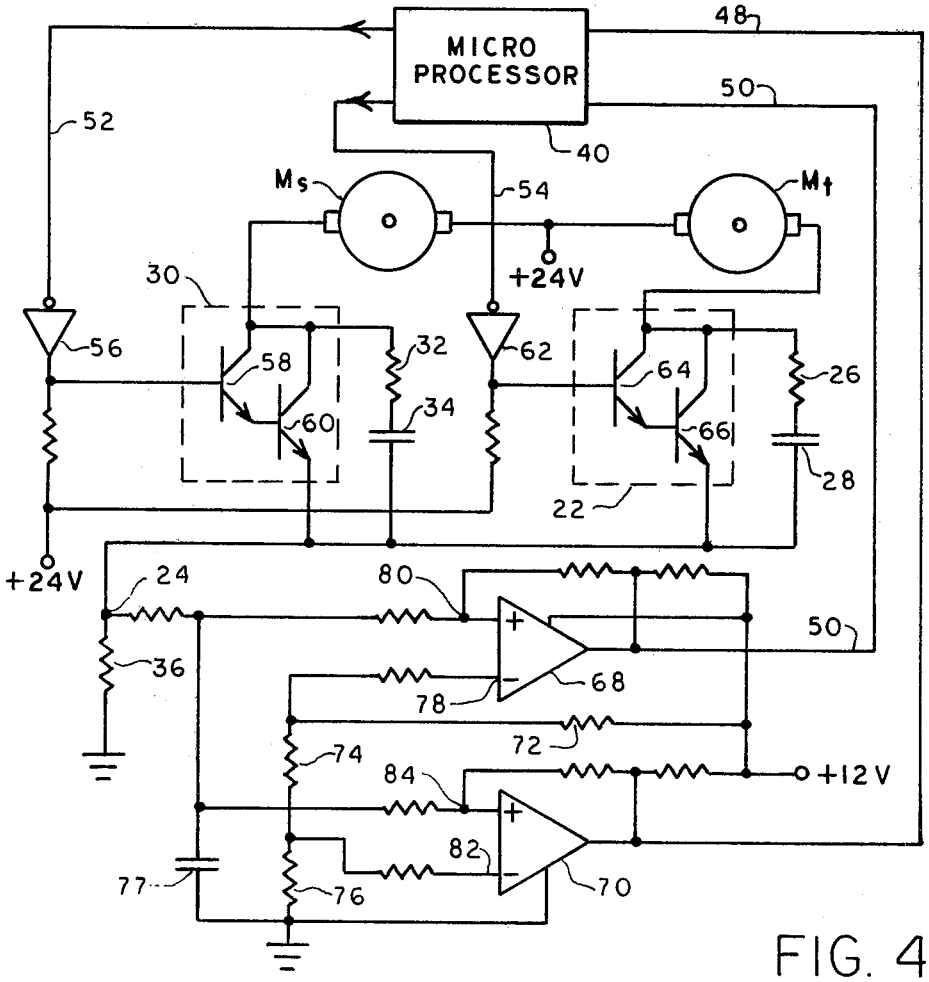
FIG. 4 is a detailed circuit diagram of a preferred embodiment of the system shown in FIG. 1.

Referring now to FIG. 4, a detailed diagram is shown as an embodiment of the transport system of FIG. 1. In this embodiment, a microprocessor functions as the logic circuit 40. In response to the comparator's inputs on leads 48 and 50, the microprocessor develops outputs on leads 52 and 54 for selectively actuating switches 30 and 22.

The signals on the lead 52 are coupled to an inverting buffer 56 whose output is applied to the switch 30. A pair of darlington-connected transistors 58 and 60 form the switch 30 and are turned on by a high level out-put from the buffer 56 for establishing a path for motor current from a +24 volt supply, through the supply motor $M_S$ and the transistors 58 and 60, and to ground through the resistor 36.

The lead 54 carries microprocessor output signals to another inverting buffer 62 for driving the switch 22. As shown, a pair of darlington-connected transistors 64 and 66 form the switch 22 and are turned on for establishing a path for motor current from the take-up motor $M_t$ to the resistor 36.

In the illustrated embodiment, the comparator 38 includes a pair of amplifiers 68 and 70, each of which receive a pair of inputs. A reference input for the amplifiers is developed by a voltage divider network comprising resistors 72, 74 and 76 which are coupled between a +12 volt supply and ground. At the junction of resistors 72 and 74, a reference voltage of 0.62 volts is established for application to an input 78 of the amplifier 68. The other input 80 is received from the node 24 and filtered by a capacitor 77.

At the junction of resistors 74 and 76, a reference voltage of 0.58 volts is established for application to an input 82 of the amplifier 70. The other input 84 thereto is received from the node 24. With this arrangement, the amplifiers 68 and 70 develop output signals which cause the microprocessor to increase the current in the motor $M_S$ when the voltage at node 24 is less than 0.58 volts. When the voltage at node 24 is greater than 0.62 volts, the microprocessor causes the current in the motor $M_S$ to be decreased. Where the sum of the motor currents causes a voltage between 0.58 volts and 0.62 volts to be developed at node 24, no change is made in the current carried by the supply motor $M_S$.

It is not necessary that the system operate with a "dead zone" between 0.58 volts and 0.62 volts, but it is thought that the inclusion of a small dead zone may eliminate oscillations in the system which may otherwise occur. If it is desired to eliminate the dead zone, one of the amplifiers 68 and 70 and its associated circuitry may be eliminated.

Figure 5:
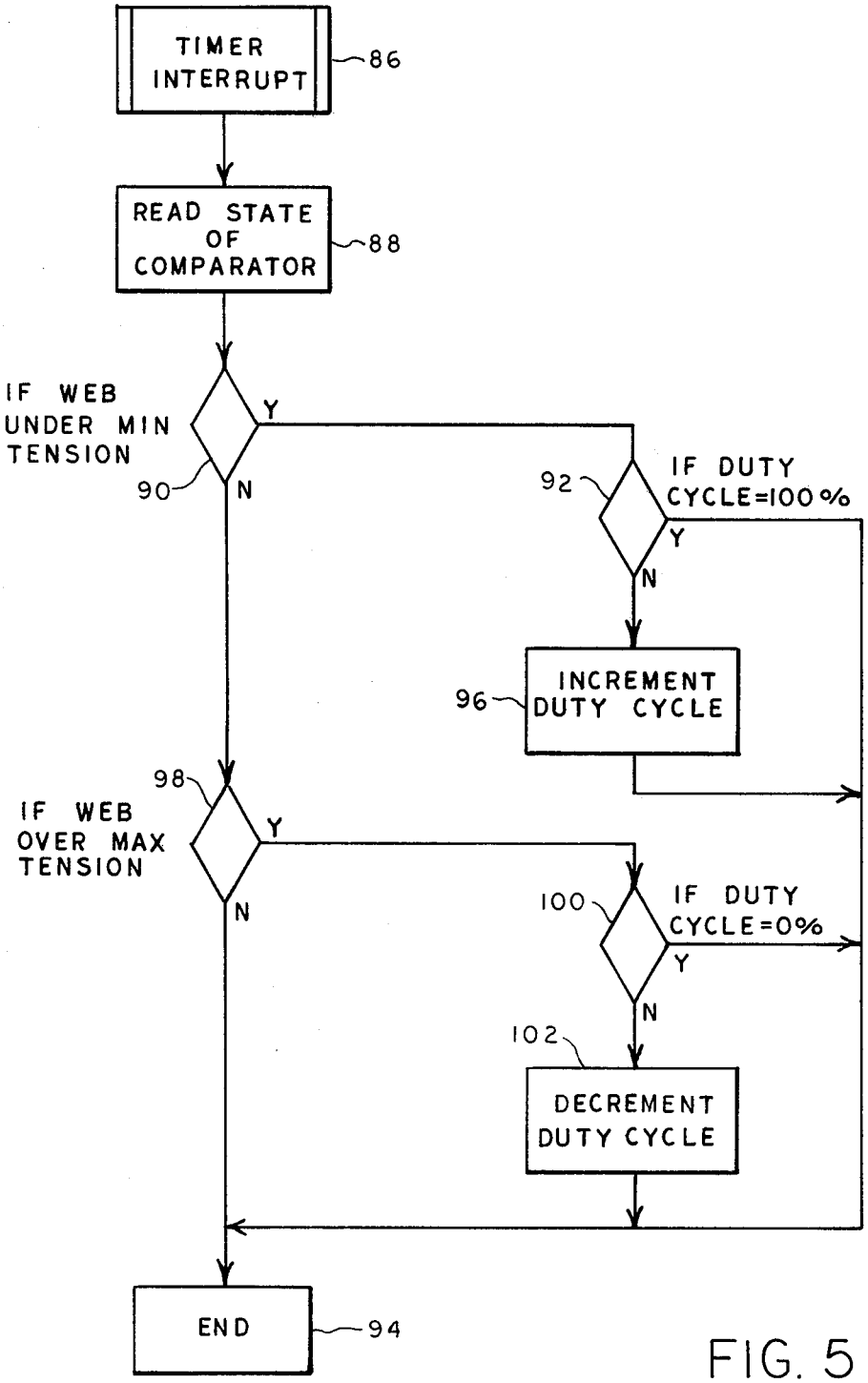
FIG. 5 is a flow chart depicting the basic logic by which the microprocessor of FIG. 4 may be programmed to alter the duty cycle of the supply motor shown in FIG. 4.

The microprocessor 40 may be any suitable device, such as the F8 microprocessor manufactured by Mostek, and may be programmed in a conventional manner. An exemplary flow chart which depicts the basic logic for establishing the duty cycle of the supply motor is shown in FIG. 5.

Because the web transport will normally be a part of a larger system such as a microfilm retrieval machine, the illustrated flow diagram will most often be a subroutine within a larger program which controls machine operation. Hence, the illustrated program will usually be executed on a periodic basis and may begin with a timer interrupt instruction 86 which permits entry into the illustrated subroutine.

Next, instruction 88 calls for the microprocessor to read the state of the comparator. Relating this instruction to FIG. 4, this operation corresponds to the microprocessor 40 reading the states of the signals on input leads 48 and 50. The microprocessor then proceeds to instruction 90 to determine whether the web is under a minimum tension, that is, whether the tension in the web is too small. This fact will be ascertainable from the value of the signals on the leads 48 and 50 of FIG. 4.

At this juncture, it should be understood that the preferred embodiment contemplates that a 100% duty cycle corresponds to a "duty cycle count" of 20. Hence, a 20% duty cycle corresponds to a duty cycle count of four. The duty cycle is changed by incrementing or decrementing the duty cycle count by one to provide a duty cycle resolution of 5%.

Returning to FIG. 4, if the web tension is too small, the microprocessor proceeds to instruction 92 which asks if the duty cycle of the supply motor is 100%, i.e., a duty cycle count of 20. If it is, its duty cycle can be increased no further, wherefore the microprocessor advances to the END instruction 94. If the duty cycle had been less than 100%, the microprocessor would have proceeded from instruction 92 to instruction 96 for incrementing the duty cycle of the supply motor. Preferably, that duty cycle is incremented by 5% (a duty cycle count of one) each time the microprocessor executes instruction 96. Having incremented the duty cycle, the microprocessor again proceeds to the END instruction 94.

Returning to instruction 90, if the microprocessor had determined that web tension was not too small, it would have proceeded to instruction 98 to determine if the web tension was over a maximum value. Once again, the answer to this question is ascertainable by reading the status of the signals on leads 48 and 50 in FIG. 4. If web tension is too great, the microprocessor proceeds to instruction 100 to determine if the supply motor's duty cycle is zero percent, i.e., a count of zero. If it is, this indicates, of course, that the supply motor's duty cycle cannot be further decreased, wherefore the microprocessor proceeds to the END instruction 94. In the case where the supply motor's duty cycle is not zero percent, the microprocessor proceeds to instruction 102 for decrementing the supply motor's duty cycle. Again, the preferred decrease in the duty cycle is 5% or a duty cycle count of one. After decrementing that duty cycle, the microprocessor again proceeds to the END instruction 94.

Referring again to instruction 98, if the web tension had not been found to be over a maximum value, the microprocessor would have proceeded directly from instruction 98 to the END instruction 94. This latter path is, of course, taken only when the web tension is at a desired level.

The flow diagram of FIG. 5 is illustrative of the manner in which the microprocessor may be programmed to modify the duty cycle of the supply motor in order to hold web tension at a desired level. Having determined what the duty cycle of the supply motor should be, it is also necessary to turn the supply motor on and off at proper intervals in order to obtain its proper duty cycle. A flow diagram which illustrates the logic for effecting this objective is shown in FIG. 6, to which reference is now made.

Figure 6:
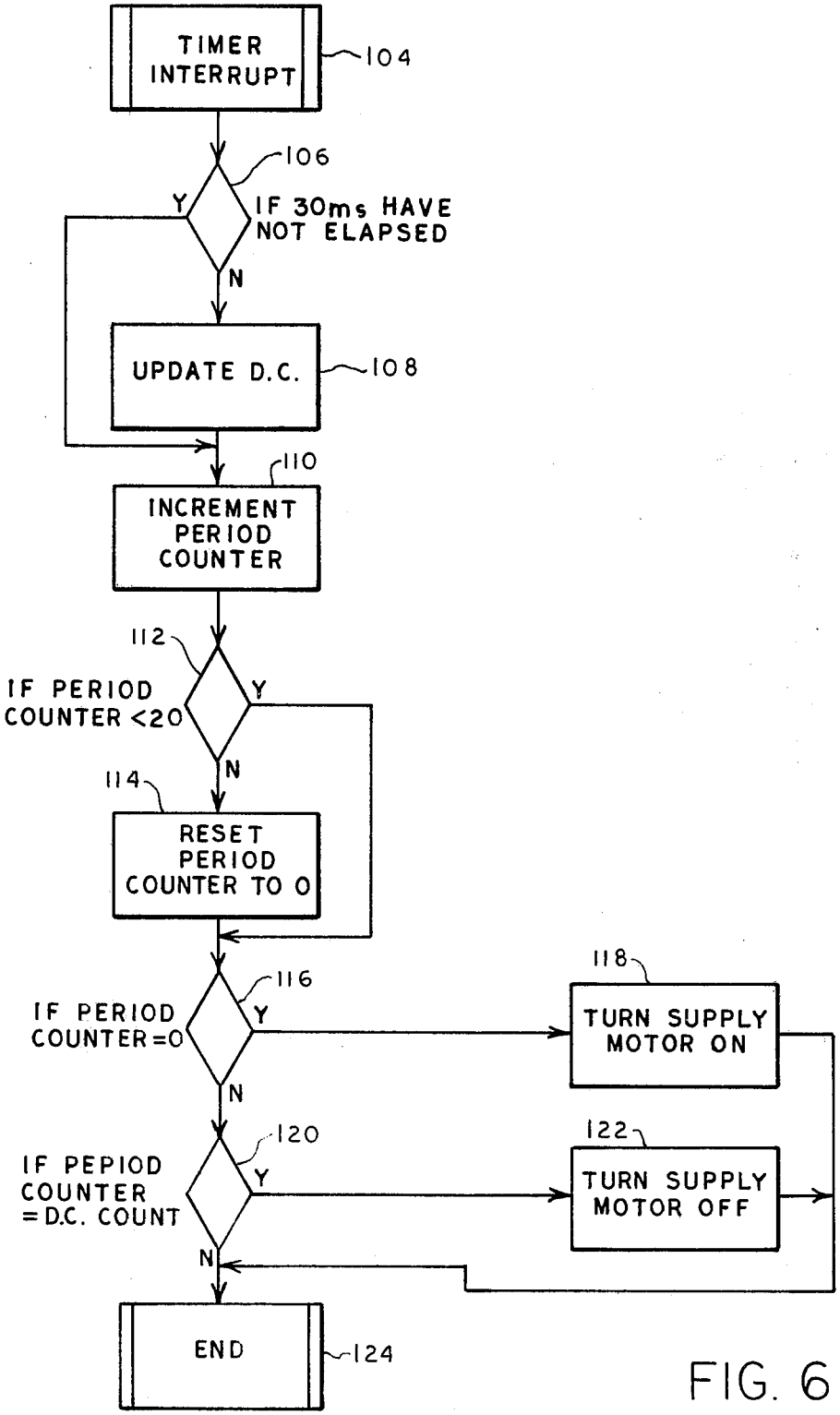
FIG. 6 is a flow chart which incorporates the logic of FIG. 5 and which illustrates further logic by which the supply motor's current may be controlled to obtain the proper duty cycle.

The diagram of FIG. 6 begins with a timer interrupt instruction 104 which may be the same as the timer interrupt instruction 66 of FIG. 5. The timer interrupt instruction 104 may be selected such that the instructions following it may be executed once every millisecond.

The microprocessor proceeds to instruction 106 to determine if 30 milliseconds have not elapsed since instruction 106 was last executed. If 30 milliseconds have elapsed, the program proceeds to instruction 108 entitled "Update D.C. (Duty Cycle)". Instruction 108 represents the entire logic of FIG. 5 wherein the supply motor's duty cycle was modified as necessary. Thus, instruction 108 is executed only once every 30 milliseconds. If 30 milliseconds had not elapsed upon the execution of instruction 106, the program bypasses instruction 108 and proceeds immediately to instruction 110.

Before describing instruction 110, it should be explained that, to control the operation of the supply motor, a period counter is preferably used which can be periodically incremented at a one millisecond rate to establish a uniform time period of twenty milliseconds, for example. At the beginning of this period, the supply motor is turned on and it is held on until the period counter has been incremented to a count equal to the previously determined duty cycle count associated with the supply motor. For example, if the supply motor's desired duty cycle has been determined to be fifty percent (a duty cycle count of 10), the supply motor is held on until the period counter is incremented to a count of 10. The supply motor is then turned off for the remainder of the period.

Referring again to instruction 110, this instruction causes the period counter to be incremented by a count of one. Next, the program advances to instruction 112 to determine if the period counter has been incremented to a count less than twenty. If the counter has reached a count of 20, the program proceeds to instruction 114 for resetting the period counter to a count of zero and the program then proceeds to instruction 116. If, however, the period counter had not yet reached a count of 20, the program proceeds from instruction 112 directly to instruction 116.

Instruction 116 causes the microprocessor to determine if the period counter is equal to zero. If it is, this is an indication that the duty cycle is just beginning, wherefore the program advances to instruction 118 for turning on the current to the supply motor. If the execution of instruction 116 resulted in a decision that the count of the period counter is not zero, the program proceeds to instruction 120. The latter instruction determines whether the supply motor has been on for its prescribed duty cycle by comparing the duty cycle count to the count in the period counter. For example, if instruction 108 (the logic of FIG. 5) had determined that the duty cycle of the supply motor should be set to 50%, then instruction 120 determines whether the period counter is equal to ten. If the counter has reached ten, this is an indication that the supply motor should be turned off, and the program advances to instruction 122.

If the execution of instruction 120 resulted in a finding that the supply motor's duty cycle had not yet been completed, the program proceeds to the END instruction 124.

It will be appreciated that the foregoing description has assumed that only one of the spools is a supply spool and that the other spool is a take-up spool. The rolls of the spools may, of course, be reversed for advancing the web in an opposite direction. In that case, the comparator and logic circuitry will control the duty cycle of the motor which was previously functioning as the take-up motor.

Because of the relative simplicity and versatility of the system, it may be used with many types of web transports. Paper and microfilm transports are but two examples of such application. Wherever used, the present web tensioning system provides a highly reliable tension control which requires no mechanical components, which is easily modified to change web tension as desired, and which is relatively inexpensive.

It will also be recognized by those skilled in the art that many alterations and modifications may be made to the illustrated system without departing from the invention. Accordingly, it is intended that all such alterations and modifications be considered as being within the spirit and scope of the invention as defined by the appended claims.

What is claimed is:

1. In a web transport which advances a web from a supply spool to a take-up spool and in which the spools are coupled, respectively, to a supply motor and a take-up motor for advancing the web, a system for holding the tension in the web substantially constant, comprising:

means coupled to both motors for developing an output signal indicative of the sum of the motor currents;

means for generating a reference signal indicative of a value of summed motor currents calculated to create a given tension on the web as the web is collected on the take-up spool;

a comparator receiving the reference signal and the output signal for generating a control signal indicative of differences between the output signal and the reference signal; and means responsive to the control signal for applying, to the supply motor, current pulses which are width-modulated so as to bring the value of the summed motor currents to within at least a selected range of the reference signal and thereby maintain a substantially constant tension in the web.

* * * * *